US009845616B2

(12) United States Patent
Lai

(10) Patent No.: US 9,845,616 B2
(45) Date of Patent: Dec. 19, 2017

(54) LOCKSET

(71) Applicant: YIFENG MANUFACTURING CO., LTD., Dongguan, Guangdong (CN)

(72) Inventor: Leo Lai, Dongguan (CN)

(73) Assignee: YIFENG MANUFACTURING CO., LTD., Dongguan (CN)

( * ) Notice: Subject to any disclaimer, the term of this patent is extended or adjusted under 35 U.S.C. 154(b) by 0 days.

(21) Appl. No.: 14/574,618

(22) Filed: Dec. 18, 2014

(65) Prior Publication Data

US 2017/0306650 A1 Oct. 26, 2017

(51) Int. Cl.

| | |
|---|---|
| ***E05B 37/00*** | (2006.01) |
| ***E05B 55/00*** | (2006.01) |
| *E05B 37/02* | (2006.01) |
| *E05B 37/12* | (2006.01) |

(52) U.S. Cl.

CPC ..... *E05B 37/0031* (2013.01); *E05B 37/00* (2013.01); *E05B 55/00* (2013.01); *E05B 37/02* (2013.01); *E05B 37/025* (2013.01); *E05B 37/12* (2013.01); *Y10T 70/7141* (2015.04)

(58) Field of Classification Search

CPC ..... Y10T 70/7141; Y10T 70/5058; Y10T 70/415; Y10T 70/7305; Y10T 70/424; Y10T 70/5053; Y10T 70/7147; E05B 37/0034; E05B 37/02; E05B 37/025; E05B 37/0031; E05B 37/12; E05B 55/00

USPC ..... 70/67–72, 284, 285, 312

See application file for complete search history.

(56) References Cited

U.S. PATENT DOCUMENTS

| | | | | | |
|---|---|---|---|---|---|
| 2,267,374 | A | * | 12/1941 | Eber | 70/5 |
| 3,736,778 | A | * | 6/1973 | Bako | 70/70 |
| 3,942,344 | A | * | 3/1976 | Gehrie et al. | 70/70 |
| 4,123,923 | A | * | 11/1978 | Bako | 70/74 |
| 4,259,856 | A | * | 4/1981 | Wingert | 70/70 |
| 4,279,136 | A | * | 7/1981 | Milles | 70/71 |
| 4,308,731 | A | * | 1/1982 | Remington | 70/74 |
| 4,318,287 | A | * | 3/1982 | Remington et al. | 70/71 |
| 4,324,120 | A | * | 4/1982 | Gisiger | 70/312 |
| 4,327,566 | A | * | 5/1982 | Ling | 70/312 |
| 4,343,163 | A | * | 8/1982 | Scelba et al. | 70/312 |
| 4,416,126 | A | * | 11/1983 | Remington | 70/71 |
| 4,441,346 | A | * | 4/1984 | Castiglioni | 70/312 |
| 4,487,043 | A | * | 12/1984 | Milles | 70/312 |
| 4,503,691 | A | * | 3/1985 | Li | 70/312 |
| 4,554,809 | A | * | 11/1985 | Yang | 70/312 |

(Continued)

*Primary Examiner* — Peter M. Cuomo
*Assistant Examiner* — Morgan J McClure
(74) *Attorney, Agent, or Firm* — Ming Chow; Sinorica, LLC

(57) ABSTRACT

A lockset comprises an upper shell and a bottom plate which are fixedly connected to each other. An accommodating space is formed between the upper shell and the bottom plate. A jack is provided on the surface of the upper shell. A locking mechanism is provided within the accommodating space. The locking mechanism comprises a locking hook fitted with the jack and a control device for controlling the locking hook to move. The locking hook comprises a hook portion accessible to the underneath of the jack and a connection portion controlled by the control device. When a code is correct, the hook portion may move toward one side of the jack; and, when the code is wrong, the connection portion is limited by the control device, and the hook portion is limited underneath the jack.

14 Claims, 3 Drawing Sheets

(56) References Cited

U.S. PATENT DOCUMENTS

| | | | | | |
|---|---|---|---|---|---|
| 4,610,152 | A | * | 9/1986 | Duringer | 70/30 |
| 4,644,767 | A | * | 2/1987 | Dueringer | 70/312 |
| 4,671,088 | A | * | 6/1987 | Jeang | 70/312 |
| 4,686,842 | A | * | 8/1987 | Chen | 70/312 |
| 4,711,108 | A | * | 12/1987 | Garro | 70/312 |
| 4,722,208 | A | * | 2/1988 | Ye | 70/312 |
| 4,727,736 | A | * | 3/1988 | Lotz | 70/312 |
| 4,854,139 | A | * | 8/1989 | Scelba | 70/68 |
| 4,970,881 | A | * | 11/1990 | Hsiao | 70/25 |
| 6,412,316 | B1 | * | 7/2002 | Buss | 70/69 |
| 6,508,089 | B1 | * | 1/2003 | Tsai | 70/213 |
| 7,266,980 | B1 | * | 9/2007 | Ma | 70/69 |
| 8,096,150 | B2 | * | 1/2012 | Lai et al. | 70/21 |
| 8,234,891 | B2 | * | 8/2012 | Dalton et al. | 70/21 |
| 2006/0248930 | A1 | * | 11/2006 | Elles et al. | 70/71 |
| 2006/0254329 | A1 | * | 11/2006 | Yu | 70/284 |
| 2007/0193316 | A1 | * | 8/2007 | Huang | 70/284 |
| 2015/0040622 | A1 | * | 2/2015 | Meersschaert et al. | 70/69 |

* cited by examiner

LOCKSET

FIELD OF THE INVENTION

The present invention relates to the technical field of mechanical locks, and particularly to a lockset.

BACKGROUND OF THE INVENTION

With the development of the economy and the improvement of people's living standard, the number of times of traveling is increasing. During traveling, people will generally carry suitcases which are opened or closed by a slide fastener. Therefore, to coordinate with such suitcases, there are various coded locks in the market. However, at present, the opening or closing of a suitcase is controlled by two fastener pieces, that is, a slide fastener is provided with two fastener pieces. When the two fastener pieces are brought into contact with each other, the suitcase is closed. At this moment, two slide fastener pieces need to be secured onto the coded locks. As for the present coded locks one locking position corresponds to one fastener piece, two fastener pieces need to be snapped and then locked into two locking positions, respectively. Such a coded lock has great hazards in use: first, there is still a certain unclosed clearance between the two fastener pieces, making crimes possible, for example, throwing unknown objects or the like into the suitcase through this clearance; and second, once one of the two locking positions is damaged, loss may be brought to the user if he or she may think it still works well.

SUMMARY OF THE INVENTION

In view of the deficiencies of the prior art, an objective of the present invention is to provide a lockset capable of achieving locking by two fastener pieces, safe use and easy operation.

The present invention employs the following technical solutions.

A lockset is provided, including an upper shell and a bottom plate which are fixedly connected to each other, an accommodating space being formed between the upper shell and the bottom plate, a jack being provided on the surface of the upper shell, a locking mechanism being provided within the accommodating space, the locking mechanism including a locking hook fitted with the jack and a control device for controlling the locking hook to move, the locking hook including a hook portion accessible to the underneath of the jack and a connection portion controlled by the control device, the hook portion being able to move toward one side of the jack when a code is correct, the connection portion being limited by the control device and the hook portion being limited underneath the jack when the code is wrong, wherein a side plate is provided on the front side of the hook portion, the side plate includes an inclined portion located at an upper end and a vertical portion located at a lower end, and the upper end of the inclined portion is inclined outward.

Further, the control device includes a code mechanism, the code mechanism including a number of code wheels, a switch member for controlling the motion of a moving portion of the locking hook and an elastic member for assisting the resetting of the switch member, the switch member being in interlocked connection with the moving portion of the locking hook; when the code is correct, the switch member is located in an unlocked position and the locking hook may move with respect to the jack to realize unlocking; and, when the code is wrong, the switch member is located in a locked position, the locking hook is limited, and the hook portion is located underneath the jack.

Further, the switch member is a shaft lever on which the code wheels are sheathed; when the code is correct, the shaft lever may move with respect to the code wheels; and, when the code is wrong, the shaft lever is limited.

Further, a spring strip is provided underneath the code mechanism, the spring strip including a fixed portion and an elastic portion fitted with the code wheels, the fixed portion being fixed on the bottom plate and the elastic portion being against the code wheels.

Furthermore, the code mechanism further includes a code adjustment structure, code adjustment wheels being provided inside the code wheels; a reset spring for resetting the shaft lever is provided at one end of the shaft lever while a code adjustment device is provided at the other end thereof, the code adjustment device including a code adjustment block and a code adjustment switch block; a shaft hole fitted with the shaft lever is provided on the code adjustment block, and a first slope for pushing the code adjustment block towards the code wheels is provided at the upper end of the code adjustment block; a second slope fitted with the first slope is provided at the lower end of the code adjustment switch block, and the first slope is against the second slope; a code adjustment hole fitted with the code adjustment switch block is provided on the upper shell; during code adjustment, the code wheels are rotated to correct positions first, then the code adjustment switch block is pressed to push the code adjustment block to move towards the code wheels and thus push the code adjustment wheels to move and press against the reset spring; after the code adjustment wheels are moved, the code wheels may be rotated with respect to the code adjustment wheels for code adjustment; at the end of code adjustment, the code adjustment switch block is loosened, and both the code adjustment wheels and the code adjustment switch reset under the action of the reset spring, so that the code adjustment is completed.

Further, the control device includes a lock cylinder device including a lock cylinder, and the lock cylinder is in interlocked connection to the connection portion of the locking hook; and, when the lock cylinder device is unlocked, the locking hook may move with respect to the jack.

Further, the control device further includes a locking block and a pushing mechanism, a lock cylinder jacket fixedly connected to the lock cylinder being provided at the lower end of the pushing mechanism; a movement space for allowing the lock cylinder device to move is provided inside the accommodating space; the lock cylinder is connected to a rotating block, a perforation and a moving hole fitted with the rotating block being provided in the middle of the locking block, the rotating block being inserted into the perforation, one end of the shaft lever being against the locking block, the moving portion of the locking hook being in interlocked connection to the lock cylinder; during unlocking with a code, the pushing mechanism may drive the lock cylinder device to move and the lock cylinder drives the locking hook to move so as to realize unlocking; when the lock cylinder device is unlocked, the rotating block may move with respect to the moving hole; the lock cylinder device may move with respect to the locking block and the lock cylinder drives the locking hook to move so as to realize unlocking; and, during locking, the shaft lever is limited and the rotating block is limited inside the perforation.

Further, the lock cylinder device further includes a connection block located underneath the locking block, a round hole fitted with the rotating block being provided at one end of the connection block while a recess being provided at the lower end of the other end thereof; and, a bump fitted with the recess is provided in the moving portion, the bump being inserted into the recess.

Further, a press block is provided underneath the code adjustment block, a positioning column is provided at the lower end of the code adjustment switch block, a positioning groove fitted with the positioning column is provided on the press block, and the positioning column of the code adjustment block is inserted into the positioning groove.

Further, an ejector block located underneath the hook portion of the locking hook is provided inside the jack, and an elastic member for ejecting the ejector block is provided between the ejector block and the bottom plate.

Further, the lockset further includes a lower shell fixedly connected to the upper shell.

The present invention has the following advantages: as the side plate of the jack is provided with its upper end being inclined outward, two fastener pieces may be easily locked when in use, and thus the slide fastener with two fastener pieces is easier for locking.

REFERENCE NUMERALS

Figure 1:
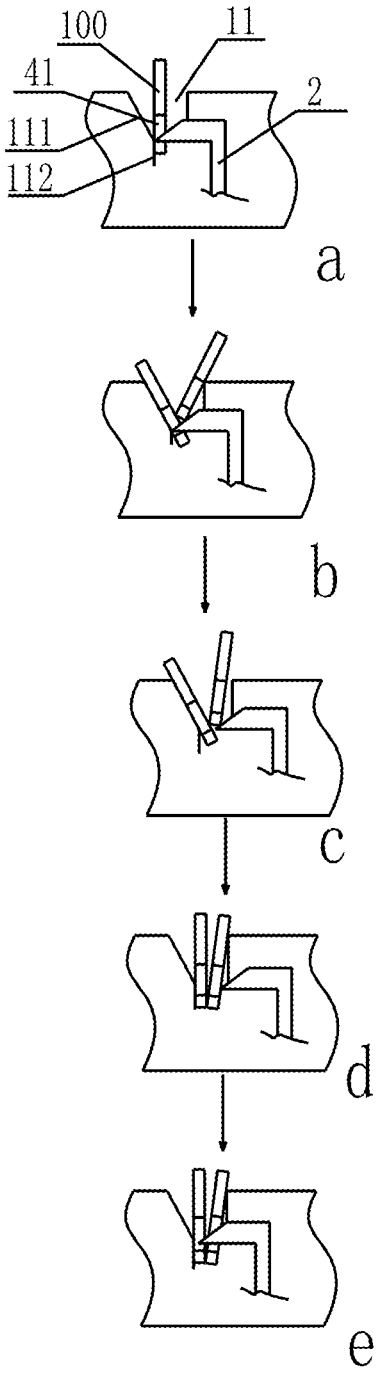
FIG. 1 is a flowchart of fitting with two fastener pieces according to the present invention.
Figure 2:
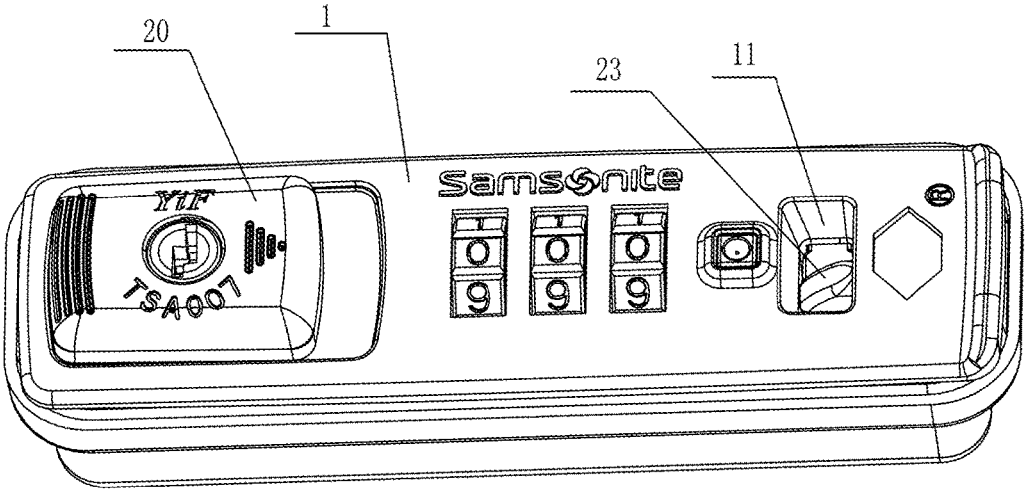
FIG. 2 is a structural diagram of the present invention.
Figure 3:
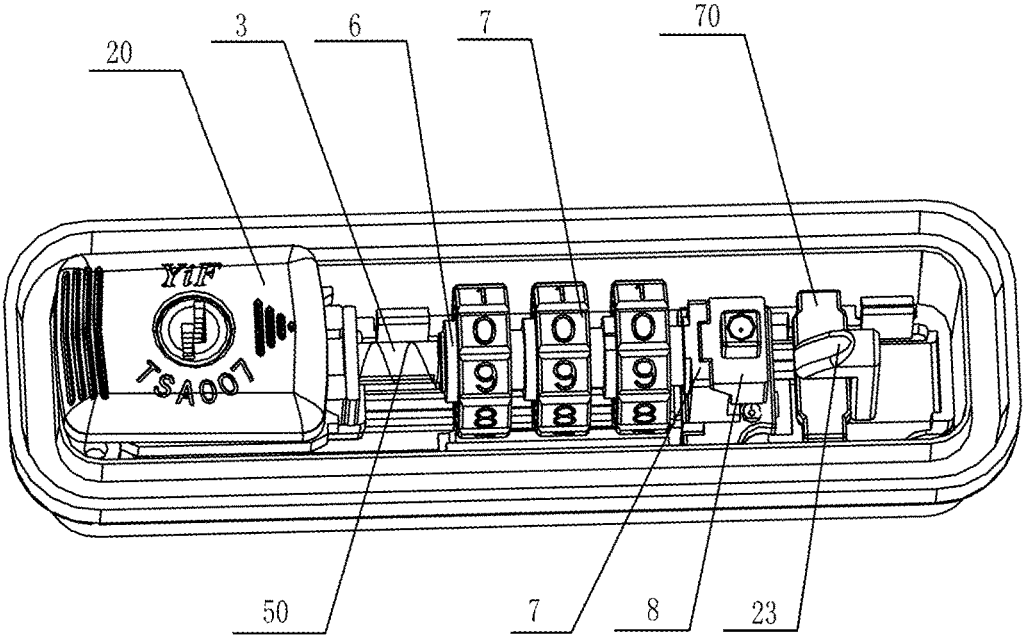
FIG. 3 is a structural diagram of the present invention, where an upper shell is removed.
Figure 4:
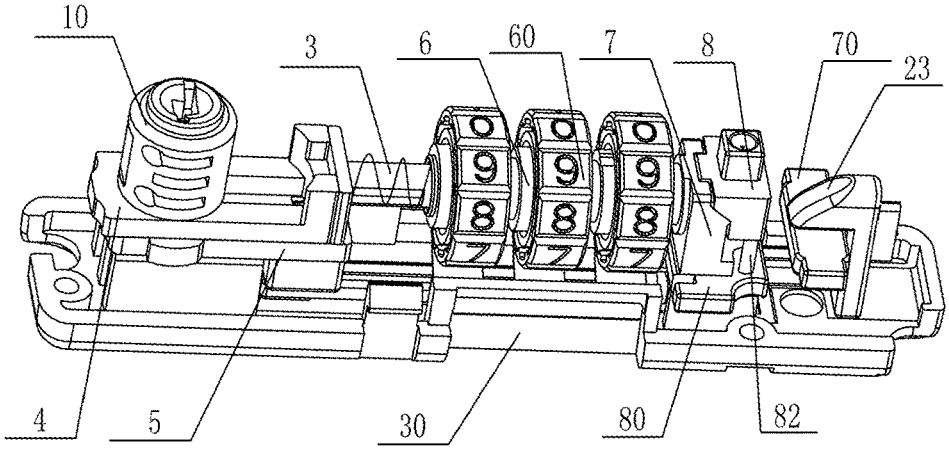
FIG. 4 is a structural diagram of the present invention, where a lower shell and a pushing mechanism are removed.
Figure 5:
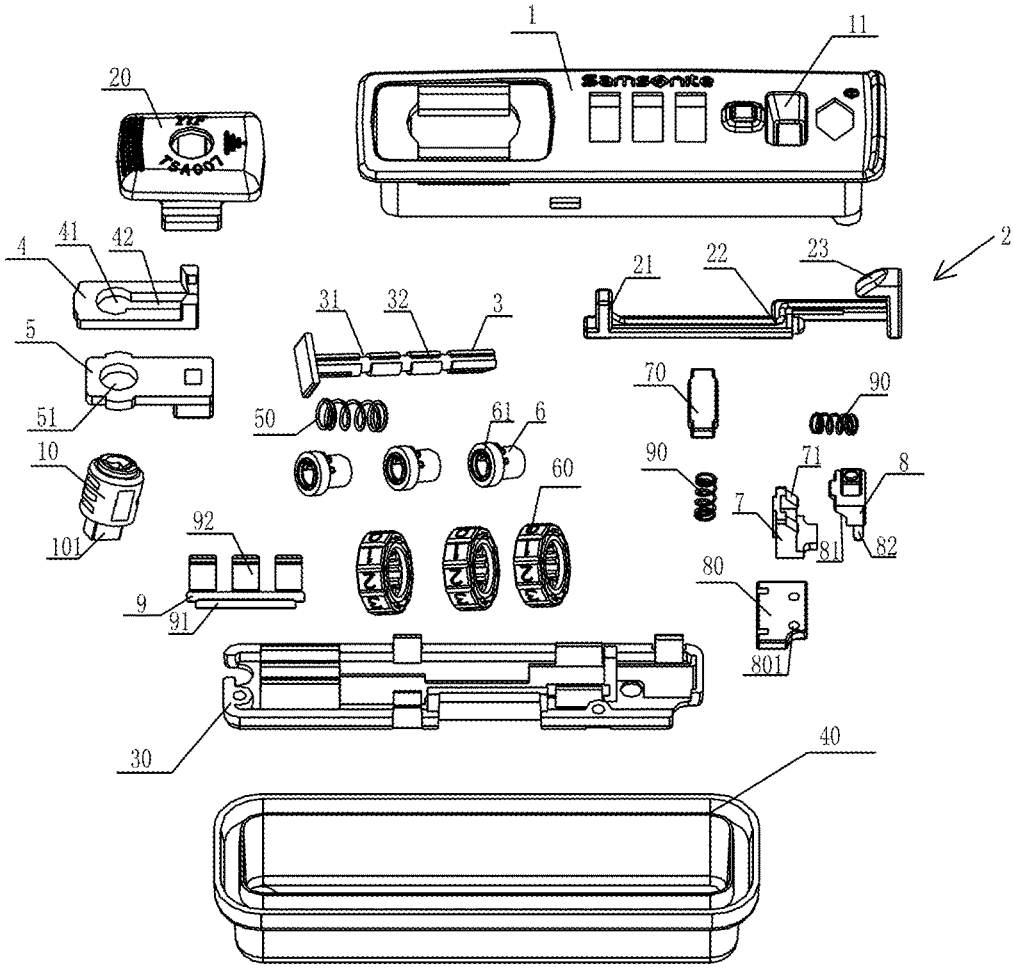
FIG. 5 is a breakdown structural diagram of FIG. 2.

1—Upper shell; 1—Jack; 111—Inclined portion; 112—Vertical portion; 2—Locking hook; 21—Bump; 22—Connection portion; 23—Hook portion; 3—Shaft lever; 31—Motion groove; 32—Moving groove; 4—Locking block; 41—Perforation; 42—Moving hole; 5—Connection block; 51—Round hole; 6—Code adjustment wheel; 61—Fixture block; 7—Code adjustment block; 71—First slope; 8—Code adjustment switch block; 81—Second slope; 82—Positioning column; 9—Spring strip; 91—Fixed portion; 92—Elastic portion; 10—Lock cylinder; 101—Rotating block; 20—Pushing mechanism; 30—Bottom plate; 40—Lower shell; 50—Reset spring; 60—Code wheel; 70—Ejector block; 80—Press block; 801—Positioning groove; 90—Elastic member; and, 100—Fastener piece.

DETAILED DESCRIPTION OF THE PREFERRED EMBODIMENTS

The present invention will be further described as below with reference to the drawings by embodiments.

Embodiment 1: as Illustrated in FIG. 1 to FIG. 5

A lockset is provided, including an upper shell 1 and a bottom plate 30 which are fixedly connected to each other. An accommodating space is formed between the upper shell 1 and the bottom plate 30. A jack 11 is provided on the surface of the upper shell 1. A locking mechanism is provided within the accommodating space. The locking mechanism includes a locking hook 2 fitted with the jack 11 and a control device for controlling the locking hook 2 to move. The locking hook 2 includes a hook portion 23 accessible to the underneath of the jack 11 and a connection portion 22 controlled by the control device. When a code is correct, the hook portion 23 is able to move toward one side of the jack 11; and, when the code is wrong, the connection portion 22 is limited by the control device and the hook portion 23 is limited underneath the jack 11. A side plate is provided in the jack 11 on the front side of the hook portion 23. The side plate includes an inclined portion 111 located at an upper end and a vertical portion 112 located at a lower end. The upper end of the inclined portion 111 is inclined outward.

When in design, the side plate of the jack 11 is designed to have an inclined upper end portion and a vertical lower end portion. Consequently, when it is needed to insert the fastener pieces 100, two fastener pieces 100 may be disorderly inserted into the jack 11 and then snapped, including the following two operations:

1) Where the right fastener piece 100 is snapped into the hook portion 23 of the locking hook 2 first and then the left fastener piece 100, the operation is very simple, and it is only needed to push the right fastener piece 100 and the hook portion 23 of the locking hook 2 rightward together, with the locking plate of the right fastener piece 100 being snapped into the hook portion 23 all the time during the pushing process; when the left fastener piece 100 enters a locking position, the locking hook 2 is reset, and, the hook portion 23 of the locking hook 2 passes through a perforation 41 of the right fastener piece 100 to a perforation 41 of the left fastener piece 100 and thus snaps the left fastener piece 100.

2) As illustrated in FIG. 1, where the left fastener piece 100 is snapped into the hook portion 23 of the locking hook 2 first, the lower end portion of the left fastener piece 100 will be against the vertical portion 112 of the lower end of the side plate of the jack 11, and the left fastener piece 100 is in a vertical state (as illustrated in FIG. 1-*a*); then, the right fastener piece 100 is ready to be inserted into the jack 11. When inserted into the jack 11, the right fastener piece 100 will resist against the upper end of the left fastener piece 100 in the jack 11. As the upper end of the jack 11 is designed inclined, the right fastener piece 100 will squeeze the left fastener piece 100 and make the left fastener piece 100 inclined, and the friction between the left fastener piece 100 and the side plate of the jack is thus increased (as illustrated in FIG. 10-*b*). The right fastener piece 100 is brought into contact with the hook portion 23 and gradually pushes the hook portion 23 rightward, so that the hook portion 23 moves rightward. Until the hook portion 23 leaves the perforation 41 of the left fastener piece 100 and gradually leaves the underneath of the jack 11 (as illustrated in FIG. 10-*c*), the lower end portion of the right fastener piece 100 enters the underneath of the jack 11. Upon entering the underneath of the jack 11, the lower end portion of the right fastener piece 100 squeezes the end portion of the left fastener piece 100, so that the lower end portion of the left fastener piece 100 resists against the vertical portion 112 of the side plate of the jack 11, and the left fastener piece 100 is in a vertical state (as illustrated in FIG. 10-*d*). Subsequently, the locking hook 2 is reset, with its hook portion 23 being gradually inserted into the perforations 41 of both the right fastener piece 10030 and the left fastener piece 100 so as to realize the snap-in connection of the two fastener pieces 100 (as illustrated in FIG. 10-*e*). During this process, the left fastener piece 100 is squeezed by the right fastener piece 100 all the rime, resulting in a large friction between the left fastener piece 100 and the side plate of the jack 11, thus preventing the left fastener piece 100 from falling off or disengaging during this process. In order to better snap the two fastener pieces 100 together, the width of the lower end of the jack 11 is equal or equivalent to the sum of the widths of the two fastener pieces 100. As a result, the right fastener piece 100 squeezes the left fastener piece 100 all the time after inserted. During a specific implementation, a side plate is further provided on the other side of the jack 11, and a through hole for allowing the hook portion 23 of the locking hook 2 to move is provided in the middle of the side plate. Thus, a spacing of the lower end of the jack 11 may be controlled.

To conveniently move the locking hook 2, an elastic member 90 for resetting the locking hook 2 is provided within the accommodating space.

Further, the control device includes a code mechanism. The code mechanism includes a number of code wheels 60, a switch member for controlling the motion of a moving portion of the locking hook 2 and an elastic member 90 for assisting the resetting of the switch member. The switch member is in interlocked connection with the moving portion of the locking hook 2. When the code is correct, the switch member is located in an unlocked position and the locking hook 2 may move with respect to the jack to realize unlocking; and, when the code is wrong, the switch member is located in a locked position, the locking hook 2 is limited, and the hook portion 23 is located underneath the jack 11.

The switch member used herein may be a locking plate, the movement of which is controlled by the code wheels 60. When the code is correct, the locking plate is in an unlocked position, the moving portion of the locking hook 2 is separated from or dislocated with the locking plate, and the locking hook 2 may move with respect to the jack 11 so as to realize unlocking. When the code is wrong, the locking plate is in a locked position, the locking plate is against or adjoins to the moving portion, and the locking hook 2 cannot move with respect to the jack 11 so as to realize locking.

Further, the switch member is a shaft lever 3 on which the code wheels 60 are sheathed. When the code is correct, the shaft lever 3 may move with respect to the code wheels 60; and, when the code is wrong, the shaft lever 3 is limited.

In the design of the code mechanism, a moving groove 32 may be transversely provided on the shaft lever 3, and fixture blocks 61 fitted with the moving groove 32 may be provided on the inside surfaces of the code wheels 60. Meanwhile, an annular motion groove 31, in which the fixture blocks 61 are located, is provided on the shaft lever 3. When the code is correct, the fixture blocks 61 are located at an overlapped portion of the motion groove 31 and the moving groove 32.

Further, a spring strip 9 is provided underneath the code mechanism, the spring strip 9 including a fixed portion 91 and an elastic portion 92 fitted with the code wheels 60, the fixed portion 91 being fixed on the bottom plate 30 and the elastic portion 92 being against the code wheels 60.

The arrangement of the spring strip 9 makes the rotation of the code wheels 60 more stable and realizes a good hand-feeling.

Furthermore, the code mechanism further includes a code adjustment structure. Code adjustment wheels 6 are sheathed inside the code wheels 60. A reset spring 50 for resetting the shaft lever 3 is provided at one end of the shaft lever 3, while a code adjustment device is provided at the other end thereof. The code adjustment device includes a code adjustment block 7 and a code adjustment switch block 8. A shaft hole fitted with the shaft lever 3 is provided on the code adjustment block 7, and a first slope 71 for pushing the code adjustment block 7 towards the code wheels 60 is provided at the upper end of the code adjustment block 7. A second slope 81 fitted with the first slope 71 is provided at the lower end of the code adjustment switch block 8, and the first slope 71 is against the second slope 8. A code adjustment hole fitted with the code adjustment switch block 8 is provided on the upper shell 1. During code adjustment, the code wheels 60 are rotated to correct positions first, and then the code adjustment switch block 8 is pressed to push the code adjustment block 7 to move towards the code wheels 60 and thus push the code adjustment wheels 6 to move and press against the reset spring 50. After the code adjustment wheels 6 are moved, the code wheels 60 may be rotated with respect to the code adjustment wheels 6 for code adjustment. At the end of code adjustment, the code adjustment switch block 8 is loosened, and both the code adjustment wheels 6 and the code adjustment switch reset under the action of the reset spring 50, so that the code adjustment is completed.

During specific arrangement, two regions are reserved on the surface of each of the code adjustment wheels 6. When the code is wrong, the code wheels 60 are connected to the code adjustment wheels 6, and the code wheels 60 drive the code adjustment wheels 6 to rotate. During code adjustment, the code adjustment wheels 6 are pushed to move by the code adjustment block 7. At this time, the code wheels 60 is unable to move due to the limitation of the code wheels 60 holes of the upper shell 1, so that the code wheels 60 are moved to the other region on the surfaces of the code adjustment wheels 60, and the code wheels 60 may be rotated with respect to the code adjustment wheels 6. After the code wheels 6 are set, fixture blocks 61 for controlling the movement of the shaft lever 3 are provided on the inside surfaces of the code adjustment wheels 6. That is, the fixture blocks 61 of the code wheels 60 are provided on the code adjustment wheels 6.

Further, the control device includes a lock cylinder 10 device including a lock cylinder 10, and the lock cylinder 10 is in interlocked connection to the connection portion 22 of the locking hook 2; and, when the lock cylinder 10 device is unlocked, the locking hook 2 may move with respect to the jack 11.

When the lock cylinder 10 device is employed, the movement of the locking hook 2 is controlled by the lock cylinder 10 device.

Further, the control device further includes a locking block 4 and a pushing mechanism 20. A lock cylinder 10 jacket fixedly connected to the lock cylinder 10 is provided at the lower end of the pushing mechanism 20. A movement space for allowing the lock cylinder 10 device to move is provided inside the accommodating space. The lock cylinder 10 is connected to a rotating block 101. A perforation 41 fitted with the rotating block 101 and a moving hole 42 communicated with the perforation 41 are provided in the middle of the locking block 4. The rotating block 101 is inserted into the perforation 41. One end of the shaft lever 3 is against the locking block 4. The moving portion of the locking hook is in interlocked connection to the lock cylinder 10. During unlocking with a code, the pushing mechanism 20 may drive the lock cylinder 10 device to move and the lock cylinder 10 drives the locking hook 2 to move so as to realize unlocking. When the lock cylinder 10 device is unlocked, the rotating block 101 may move with respect to the moving hole 42. The lock cylinder 10 device may move with respect to the locking block 4 and the lock cylinder 10 drives the locking hook 2 to move so as to realize unlocking. During locking, the shaft lever 3 is limited and the rotating block 101 is limited inside the perforation 41. The rotating block 101 may be of a cuboid or cam structure.

Through the arrangement of the locking block 4, the pushing mechanism 20 and the like, a combination lock is formed, that is, the lock may be opened with a code or a key. During specific operation, the locking hook 2 is connected to the lock cylinder 10 via the connection portion 22, and the locking hook is driven to move by the transverse movement of the lock cylinder 10 so as to realize unlocking. To enable the lock cylinder 10 to move, there are following two technical solutions. First, unlocking with a code: after unlocking with a code, the shaft lever 3 may move with respect to the code wheels 60 or the code adjustment wheels 6, so that the shaft lever 3 may push the lock cylinder 10 device to move transversely, and the lock cylinder 10 drives the locking hook 2 to move to realize unlocking. Second, unlocking with a key: after the lock cylinder 10 device is unlocked, the rotating block 101 is fitted with the moving hole 42, so that the rotating block 101 may move within the moving hole 42. At this time, although the locking block 4 is against the shaft lever 3 and the shaft lever 3 is limited, the loch cylinder 10 device may still be pushed, the rotating block 101 enters the moving hole 42 through the perforation 41, and the lock cylinder 10 drives the locking hook 2 to move so as to realize unlocking. Next, the reset spring 50 may be sheathed on the shaft lever 3 and located between the locking block 4 and the code wheels 60. During unlocking with a code, the shaft lever 3 is moved and then compresses the reset spring 50. After unlocking, the shaft lever 3 resets through the reset spring 50. Of course, the reset spring 50 may also be provided between the locking block 4 and the shaft lever 3.

Further, the lock cylinder 10 device further includes a connection block 5 located underneath the locking block 4; a round hole 51 fitted with the rotating block 101 is provided at one end of the connection block 5 while a recess is provided at the lower end of the other end thereof; and, a bump 21 fitted with the jack 11 is provided in the moving portion, and the bump 21 is inserted into the recess.

The arrangement of the connection block 5 and the bump 21 is convenient for the connection of the lock cylinder 10 to the moving portion, so that interlock is formed between the lock cylinder 10 and the moving portion.

Further, a press block 80 is provided underneath the code adjustment block 7, a positioning column 82 is provided at the lower end of the code adjustment switch block 8, a positioning groove 801 fitted with the positioning column 82 is provided on the press block 80, and the positioning column 82 of the code adjustment block 8 is inserted into the positioning groove 801.

During code adjustment, the code adjustment switch block 8 and the code adjustment block 7 will move with respect to each other. To remain the motion orientation of the code adjustment switch block 8 and prevent the code adjustment switch block 8 from shifting, the press block 80, the positioning column 82 and the positioning groove 801 are provided.

Further, an ejector block 70 located underneath the hook portion 23 of the locking hook 2 is provided inside the jack 11, and an elastic member 90 for ejecting the ejector block 70 is provided between the ejector block 70 and the bottom plate 30.

After the arrangement of the ejector block 70, during unlocking, the ejector block 70 bounces the fastener pieces 100, so that it is convenient to use. The elastic member 90 may be a spring, a spring strip, etc.

Further, the lockset further includes a lower shell 40 fixedly connected to the upper shell 30.

Although the present invention has been described in details, a person of ordinary skill in the art should understand that modifications or equivalent replacements may be made to the technical solutions of the present invention without departing from the essence and scope of the technical solutions of the present invention.

What is claimed is:

1. A lockset, comprising:

an upper shell and a bottom plate which are fixedly connected to each other, an accommodating space being formed between the upper shell and the bottom plate, a jack being provided on the surface of the upper shell, a locking mechanism being provided within the accommodating space, the locking mechanism comprising a locking hook fitted with the jack and a control device for controlling the locking hook to move, the locking hook comprising a hook portion accessible to the underneath of the jack and a connection portion controlled by the control device, the hook portion being able to move toward one side of the jack when a code is correct, the connection portion being limited by the control device and the hook portion being limited underneath the jack when the code is wrong, an inclined portion and a vertical portion being provided on the front side of the hook portion, the inclined portion being located at an upper end, the vertical portion being located at a lower end, and the upper end of the inclined portion being inclined outward;

the control device comprising a code mechanism, the code mechanism comprising a number of code wheels, a switch member for controlling the motion of a moving portion of the locking hook and an elastic member for assisting the resetting of the switch member, the switch member being in interlocked connection with the moving portion of the locking hook; when the code is correct, the switch member is located in an unlocked position and the locking hook can move with respect to the jack to realize unlocking; when the code is wrong, the switch member is located in a locked position, the locking hook is limited, and the hook portion is located underneath the jack;

the switch member being a shaft lever on which the code wheels are sheathed; when the code is correct, the shaft lever can move with respect to the code wheels; when the code is wrong, the shaft lever is limited; and the code mechanism further comprising a code adjustment structure, code adjustment wheels being provided inside the code wheels; a reset spring for resetting the shaft lever being provided at one end of the shaft lever while a code adjustment device is provided at the other end thereof, the code adjustment device comprising a code adjustment block and a code adjustment switch block; a shaft hole fitted with the shaft lever being provided on the code adjustment block, and a first slope for pushing the code adjustment block towards the code wheels being provided at the upper end of the code adjustment block; a second slope fitted with the first slope being provided at the lower end of the code adjustment switch block, and the first slope being against the second slope; a code adjustment hole fitted with the code adjustment switch block being provided on the upper shell; during code adjustment, the code wheels are rotated to correct positions first, then the code adjustment switch block is pressed to push the code adjustment block to move towards the code wheels and thus push the code adjustment wheels to move and press against the reset spring; after the code adjustment wheels are moved, the code wheels can be rotated with respect to the code adjustment wheels for code adjustment; at the end of code adjustment, the code adjustment switch block is loosened, and both the code adjustment wheels and the code adjustment switch reset under the action of the reset spring, so that the code adjustment is completed.

2. The lockset according to claim 1, wherein the control device comprises a lock cylinder device comprising a lock cylinder, and the lock cylinder is in interlocked connection to the connection portion of the locking hook; and, when the lock cylinder device is unlocked, the locking hook can move with respect to the jack.

3. The lockset according to claim 2, wherein the control device further comprises a locking block and a pushing mechanism, a lock cylinder jacket fixedly connected to the lock cylinder being provided at the lower end of the pushing mechanism; a movement space for allowing the lock cylinder device to move is provided inside the accommodating space; the lock cylinder is connected to a rotating block, a perforation and a moving hole fitted with the rotating block being provided in the middle of the locking block, the rotating block being inserted into the perforation, one end of the shaft lever being against the locking block, the moving portion of the locking hook being in interlocked connection to the lock cylinder; during unlocking with a code, the pushing mechanism can drive the lock cylinder device to move and the lock cylinder drives the locking hook to move so as to realize unlocking; when the lock cylinder device is unlocked, the rotating block can move with respect to the moving hole; the lock cylinder device can move with respect to the locking block and the lock cylinder drives the locking hook to move so as to realize unlocking; and, during locking, the shaft lever is limited and the rotating block is limited inside the perforation.

4. The lockset according to claim 3, wherein the lock cylinder device further comprises a connection block located underneath the locking block, a round hole fitted with the rotating block being provided at one end of the connection block; and, a bump fitted with the connection block is provided in the moving portion, the bump being inserted into a lower end of the other end of the connection block.

5. The lockset according to claim 1, wherein a spring strip is provided underneath the code mechanism, the spring strip comprising a fixed portion and an elastic portion fitted with the code wheels, the fixed portion being fixed on the bottom plate and the elastic portion being against the code wheels.

6. The lockset according to claim 5, wherein an ejector block located underneath the hook portion of the locking hook is provided inside the jack, an elastic member for ejecting the ejector block is provided between the ejector block and the bottom plate, and the lockset further comprises a lower shell fixedly connected to the upper shell.

7. The lockset according to claim 1, wherein the control device comprises a lock cylinder device comprising a lock cylinder, and the lock cylinder is in interlocked connection to the connection portion of the locking hook; and, when the lock cylinder device is unlocked, the locking hook can move with respect to the jack.

8. The lockset according to claim 7, wherein the control device further comprises a locking block and a pushing mechanism, a lock cylinder jacket fixedly connected to the lock cylinder being provided at the lower end of the pushing mechanism; a movement space for allowing the lock cylinder device to move is provided inside the accommodating space; the lock cylinder is connected to a rotating block, a perforation and a moving hole fitted with the rotating block being provided in the middle of the locking block, the rotating block being inserted into the perforation, one end of the shaft lever being against the locking block, the moving portion of the locking hook being in interlocked connection to the lock cylinder; during unlocking with a code, the pushing mechanism can drive the lock cylinder device to move and the lock cylinder drives the locking hook to move so as to realize unlocking; when the lock cylinder device is unlocked, the rotating block can move with respect to the moving hole; the lock cylinder device can move with respect to the locking block and the lock cylinder drives the locking hook to move so as to realize unlocking; and, during locking, the shaft lever is limited and the rotating block is limited inside the perforation.

9. The lockset according to claim 8, wherein the lock cylinder device further comprises a connection block located underneath the locking block, a round hole fitted with the rotating block being provided at one end of the connection block; and, a bump fitted with the connection block is provided in the moving portion, the bump being inserted into a lower end of the other end of the connection block.

10. The lockset according to claim 1, wherein a press block is provided underneath the code adjustment block, a positioning column is provided at the lower end of the code adjustment switch block, a positioning groove fitted with the positioning column is provided on the press block, and the positioning column of the code adjustment block is inserted into the positioning groove.

11. The lockset according to claim 1, wherein an ejector block located underneath the hook portion of the locking hook is provided inside the jack, an elastic member for ejecting the ejector block is provided between the ejector block and the bottom plate, and the lockset further comprises a lower shell fixedly connected to the upper shell.

12. The lockset according to claim 1, wherein an ejector block located underneath the hook portion of the locking hook is provided inside the jack, an elastic member for ejecting the ejector block is provided between the ejector block and the bottom plate, and the lockset further comprises a lower shell fixedly connected to the upper shell.

13. The lockset according to claim 1, wherein an ejector block located underneath the hook portion of the locking hook is provided inside the jack, an elastic member for ejecting the ejector block is provided between the ejector block and the bottom plate, and the lockset further comprises a lower shell fixedly connected to the upper shell.

14. The lockset according to claim 1, wherein an ejector block located underneath the hook portion of the locking hook is provided inside the jack, an elastic member for ejecting the ejector block is provided between the ejector block and the bottom plate, and the lockset further comprises a lower shell fixedly connected to the upper shell.

* * * * *